US010603533B2

(12) United States Patent
Huelsen et al.

(10) Patent No.: US 10,603,533 B2
(45) **Date of Patent: *Mar. 31, 2020**

(54) METHOD FOR REDUCING NOISE AND ROOM AIR OVERPRESSURE ON DISCHARGE OF A GAS EXTINGUISHER SYSTEM

(71) Applicant: SIEMENS SCHWEIZ AG, Zurich (CH)

(72) Inventors: Gerd Huelsen, Bodolz (DE); Benno Rupp, Goldach (CH)

(73) Assignee: Siemens Schweiz AG, Zurich (CH)

( * ) Notice: Subject to any disclaimer, the term of this patent is extended or adjusted under 35 U.S.C. 154(b) by 68 days.

This patent is subject to a terminal disclaimer.

(21) Appl. No.: 15/814,444

(22) Filed: Nov. 16, 2017

(65) Prior Publication Data

US 2018/0071561 A1 Mar. 15, 2018

Related U.S. Application Data

(62) Division of application No. 14/696,641, filed on Apr. 27, 2015, now Pat. No. 9,889,326.

(30) Foreign Application Priority Data

Apr. 25, 2014 (EP) ..... 14165943

(51) Int. Cl.
*A62C 35/02* (2006.01)
*A62C 99/00* (2010.01)
(Continued)

(52) U.S. Cl.
CPC ..... *A62C 35/023* (2013.01); *A62C 99/0018* (2013.01); *A62C 35/68* (2013.01);
(Continued)

(58) Field of Classification Search
CPC ..... A62C 35/023; A62C 35/68; A62C 37/08; A62C 37/50
(Continued)

(56) References Cited

U.S. PATENT DOCUMENTS 2,311,845 A 2/1943 Lindsay
5,996,699 A 12/1999 Sundholm ..... A62C 35/023 169/16
(Continued)

FOREIGN PATENT DOCUMENTS

FR 2725776 A1 4/1996
WO 2009126155 A1 4/2008
WO 2010071622 A1 6/2010

OTHER PUBLICATIONS

Wagner Group GMBH, "FirExting Inert gas extinguishing systems", Jan. 2015, pp. 1-12, URL: http://www.wagner-uk.com/uploads/tx_wwdownloads/WAGNER_FirExting_EN.pdf.

*Primary Examiner* — Jason J Boeckmann
(74) *Attorney, Agent, or Firm* — Laurence Greenberg; Werner Stemer; Ralph Locher

(57) ABSTRACT

Noise and room air overpressure on discharge of a gas extinguisher system is reduced. During the discharge, an extinguishing fluid is conveyed from a pressurized container via a container valve and line system to an extinguishing nozzle. At the beginning of the discharge the extinguishing fluid is predominantly present in the line system in liquid phase and after discharge it assumes a predominantly gaseous phase. In a phase transition period, which is accompanied by a significant reduction in the extinguishing fluid mass flow and a significant increase in the noise and the room air pressure, the mass flow is then reduced or stopped. Due to the reduction of the mass flow, the sound level of the noise arising is advantageously reduced to a value of a
(Continued)

maximum of 100 dB and the room air pressure to an overpressure value ranging from 200 to 1000 Pa.

7 Claims, 3 Drawing Sheets

(51) Int. Cl.
*A62C 37/08* (2006.01)
*A62C 35/68* (2006.01)
*A62C 37/50* (2006.01)

(52) U.S. Cl.
CPC ..... *A62C 37/08* (2013.01); *A62C 37/50* (2013.01); *A62C 99/0027* (2013.01)

(58) Field of Classification Search
USPC ..... 169/9, 11
See application file for complete search history.

(56) References Cited

U.S. PATENT DOCUMENTS

| | | | | |
|---|---|---|---|---|
| 7,434,628 | B2 * | 10/2008 | Scheidt | A62C 3/08 169/16 |
| 8,915,307 | B2 | 12/2014 | Lelic et al. | |
| 9,079,054 | B2 | 7/2015 | Claessen | A62C 35/68 |
| 2011/0180276 | A1 | 7/2011 | Khalil et al. | |

* cited by examiner

METHOD FOR REDUCING NOISE AND ROOM AIR OVERPRESSURE ON DISCHARGE OF A GAS EXTINGUISHER SYSTEM

CROSS-REFERENCE TO RELATED APPLICATION

This application is a divisional of patent application Ser. No. 14/696,641, filed Apr. 27, 2015; which claims the priority, under 35 U.S.C. § 119, of European patent application No. EP 14165943.3, filed Apr. 25, 2014; the prior applications are herewith incorporated by reference in their entirety.

BACKGROUND OF THE INVENTION

Field of the Invention

Gas extinguisher systems and extinguishing methods are known from the prior art in which, during the discharge, an extinguishing fluid is conveyed from a pressurized container via a container valve and line system to one or more extinguishing nozzles. The extinguishing fluid stored in the pressurized container has an extinguishing liquid and a propellant gas. The extinguishing liquid is preferably a chemically-acting extinguishing liquid. It is especially based on halons, such as on HFC-227ea or HFC-23 for example, or on fluorinated ketones, such as on FK-5-1-12 for example which is sold under the brand name Novec® 1230. The propellant gas is preferably an inert gas, such as nitrogen or argon, or carbon dioxide.

The extinguishing fluid is present in the line system at the start of the discharge primarily in its liquid phase. After the extinguishing liquid is discharged the extinguishing fluid in the line system then moves into a primarily gaseous phase. "Primarily" here means a proportion by volume of the respective phase in relation to the other phase of more than 90%. In respect of the time of the phase transition, this is the period of time in which the propellant gas in the pressurized container conveys or "pushes out" the extinguishing liquid therein from the pressurized container, until eventually only the propellant gas is present in the pressurized container. This remaining propellant gas is also emptied out via the connected line system and onwards via the nozzles until there is a typically unpressurized state.

It is also known that, on activation of and during the discharge of such a gas extinguisher system, noise levels of up to 110 dB and more can develop. If magnetic hard disks are located in protected rooms, such as in data centers for example, which are linked to such a gas extinguisher system, then it is known that, as from a noise level of more than 100 dB said disks can be adversely affected and in some cases can even fail.

SUMMARY OF THE INVENTION

It is accordingly an object of the invention to provide a method and system which overcomes the above-mentioned and other disadvantages of the heretofore-known devices and methods of this general type and which reduces the noise and the room air overpressure.

With the foregoing and other objects in view there is provided, in accordance with the invention, a method of reducing noise and room air overpressure on discharge of a gas extinguisher system, the method comprising:

during the discharge, conveying an extinguishing fluid from a pressurized container via a container valve and line system to an extinguishing nozzle, the extinguishing fluid stored in the pressurized container having an extinguishing liquid and a propellant gas, wherein the extinguishing fluid is present in the line system at the beginning of the discharge predominantly in a liquid phase and, after discharge, the extinguishing liquid changes into a predominantly gaseous phase; and during a phase transition period that is associated with a significant reduction in an extinguishing fluid mass flow and a significant increase in the noise and a room air pressure, reducing or stopping the mass flow.

In other words, the objects of the invention are achieved in that, in a phase transition range, which is associated with a significant reduction of the extinguishing fluid mass flow and a significant increase in the noise and the room air pressure, the volume flow or the mass flow is reduced or stopped.

Through this the further increase of noise is advantageously effectively reduced, so that noise-sensitive components in the area of the extinguishing nozzles, such as magnetic hard disks for example, will not be adversely affected.

A further advantage is that pressure equalization flaps in protected rooms, which are opened to reduce the room overpressure in order to minimize harm to the building and to people in the event of a gas extinguisher system being activated, can now be dimensioned smaller. The constructional outlay is reduced, as is the cost outlay.

According to a method variant the mass flow is reduced such that the noise level of the noise arising is restricted to a maximum value of 100 dB.

In accordance with one method variant, the mass flow is reduced such that the room air overpressure is restricted to an overpressure value ranging from 200 to 1000 Pa.

Through this the risk of harm to persons located in protected rooms is advantageously minimized. The room air overpressure in this case is related to the normal atmospheric pressure obtaining in the environment of the gas extinguisher system as a reference level. Under normal circumstances, i.e. in the non-activated state of the gas extinguisher system, it corresponds to the ambient air pressure.

In accordance with a preferred embodiment of the invention, the (active) reduction of the mass flow is time-controlled. In this case the pressure is reduced using a timer with a predetermined delay time, such as by way of a time relay for example. Via this relay a choke or a reduction valve in the line system of the gas extinguisher system can be activated, at least indirectly actuated by an actuator signal of the gas extinguisher system, in order to reduce the mass flow of the extinguishing fluid. The timer can also be realized pneumatically or hydraulically, as can the activation of the choke. The delay time which can be set preferably lies in the range of 5 to 15 seconds, especially in a range of 7 to 10 seconds.

The mass flow reduction can also be controlled by the pressure in the line, such as by means of a pressure sensor for detecting the line pressure for example.

The mass flow reduction can also be controlled by the ambient air pressure, i.e. controlled by a room air pressure obtaining in the gas extinguisher system, such as by means of an air pressure sensor or differential pressure sensor for example. If the room air overpressure exceeds a predetermined overpressure value, such as a pressure value of 200 Pa for example, then the choke is activated to reduce the mass flow.

The mass flow reduction can also be controlled by measuring the noise, such as e.g. by a microphone or a structure-borne sound sensor.

The mass flow can also be reduced, as an alternative or in addition via the actual fill level of the pressurized container. In this case a fill level meter can be disposed in the pressurized container, such as a float for example. The fill level meter can also be an ultrasound fill level meter.

Furthermore the mass flow can be reduced by the current weight of the pressurized container, which decreases with the increasing discharge of the pressurized container. The current weight of the container can be measured by means of a weighing facility, such as scales or a force-measuring cell for example.

Furthermore, as an alternative or in addition, the mass flow can be reduced via a value acquired by measurement technology for the mass flow, such as by means of a throughflow meter, a volume flow meter or a mass flow meter for example. Such measurement devices, in respect of technology, can acquire the throughflow on the basis of a rotating vane wheel or a fluid pressure falling along a measurement path. The flow can also be measured by optical means, such as on the basis of a change in the refractive index during the liquid and gaseous phase, or by means of ultrasound.

In accordance with a variant of the method the mass flow is reduced in a single stage. This makes an especially simple realization of the mass flow of the extinguishing fluid possible. As an alternative a two-stage or in general a multistage reduction of the mass flow is also conceivable. With the above and other objects in view there is also provided, in accordance with the invention, a gas extinguisher system, comprising:

at least one pressurized container for pressurized storage of an extinguishing fluid, the extinguishing fluid having an extinguishing liquid and a propellant gas;

a line system connecting said at least one pressurized container via a container valve or a container valve actuator to at least one extinguishing nozzle;

an actuator for opening a respective said container valve for discharging the extinguishing fluid into said line system;

a choke disposed in said line system and controllable for reducing or stopping an extinguishing fluid mass flow; and a control facility configured to activate said choke on phase transition of the extinguishing fluid from a predominantly liquid phase into a predominantly gaseous phase.

In other words, the object of the invention are further achieved by a gas extinguisher system which has at least one pressurized container for preparatory pressurization of an extinguishing fluid. The extinguishing fluid has an extinguishing liquid and a propellant gas. The respective pressurized container is connected via a container valve or via a container valve actuator on a line system to at least one extinguishing nozzle. The line system can comprise conduit pipes, collector pipes and/or pressure hoses.

Furthermore the gas extinguisher system has an actuator to open the respective container in order to discharge the extinguishing fluid into the line system.

Typically all container valves have an actuator. The actuator on the first container valve is activated by the alarm control center. The remaining actuators are then preferably activated together by the first opened pressurized container.

The actuator can be an electrically activated, a pneumatically activated, or an hydraulically activated actuator, which is connected mechanically to the respective container valve for opening. The gas extinguisher system also includes a choke or reduction valve, which is disposed in the line system. The choke is able to be activated via a control facility of the gas extinguisher system for (further active) reduction or also for stopping the extinguishing fluid mass flow. The control facility is configured to activate the choke on phase transition from a predominantly liquid phase into a predominantly gaseous phase.

Through the activation of the choke the extinguishing fluid-mass flow is reduced. If the mass flow is already being reduced as a result of the phase transition of the extinguishing fluid from the predominantly liquid phase into the predominantly gaseous phase, then the mass flow is actively reduced further by the activation of the choke.

In accordance with a form of embodiment of the gas extinguisher system the choke is dimensioned for reduction of the mass flow in the line system such that the noise level of the noise arising is able to be limited to a maximum value of typically 100 dB. This can be done for example as part of the type testing of such a gas extinguisher system. As part of the dimensioning, perforated sheets with different flow diameters can be tested for example.

According to a further form of embodiment the choke is dimensioned so that room air overpressure is able to be restricted to an overpressure value of between 200 and 1000 Pa. The choke can also be dimensioned so that both the previously mentioned maximum noise level value and also the overpressure value are adhered to.

The control facility of the inventive gas extinguisher system can have a triggerable time delay element, i.e. a timer. In the simplest case the control facility has an external electrical input for this purpose for triggering the time delay element. The time delay element can then be triggered by the actuator, by an upstream fire alarm control center or also by a manually-actuatable fire alarm button for activating the choke. The actuator, the fire alarm control center and also the fire alarm button can then be connected to the electrical trigger input of the control facility.

The control facility can also have a first pressure sensor for detecting the line pressure in the line system of the gas extinguisher system and/or a second pressure sensor for detecting the room air overpressure in an area of the gas extinguisher system remote from the extinguishing nozzles. "Remote" here means that the second pressure sensor is not to be disposed in the outlet sector or outflow area of the extinguishing nozzles.

Furthermore, as an alternative or in addition, the control facility has a microphone for picking up the noise in the area of the gas extinguisher system and/or a structure-borne sensor attached to components of the gas extinguisher system for picking up the structure-borne sound.

The control facility can furthermore have a mass flow sensor for detecting the extinguishing fluid mass flow flowing in the line system. The mass flow meter can be disposed in this case, viewed in the flow direction of the extinguishing fluid, before the choke or also after the choke.

According to one form of embodiment the control facility and the choke can be combined into one unit. The control facility has hydrodynamically and/or hydrostatically-acting components for actuating the choke. The unit consisting of control facility and choke can also be "free of electronics," meaning that it is realized without electronic components, such as by using mechanical, hydraulic and/or pneumatic components for example.

According to a further form of embodiment the extinguishing fluid has a chemically-acting extinguishing liquid based on halons and an inert gas, such as nitrogen or argon, or carbon dioxide as its propellant gas.

Other features which are considered as characteristic for the invention are set forth in the appended claims.

Although the invention is illustrated and described herein as embodied in a method and system for the reduction of noise and room air overpressure on discharge of a gas extinguisher system by active reduction of the extinguishing fluid mass flow on transition from the fluid to the gaseous phase, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
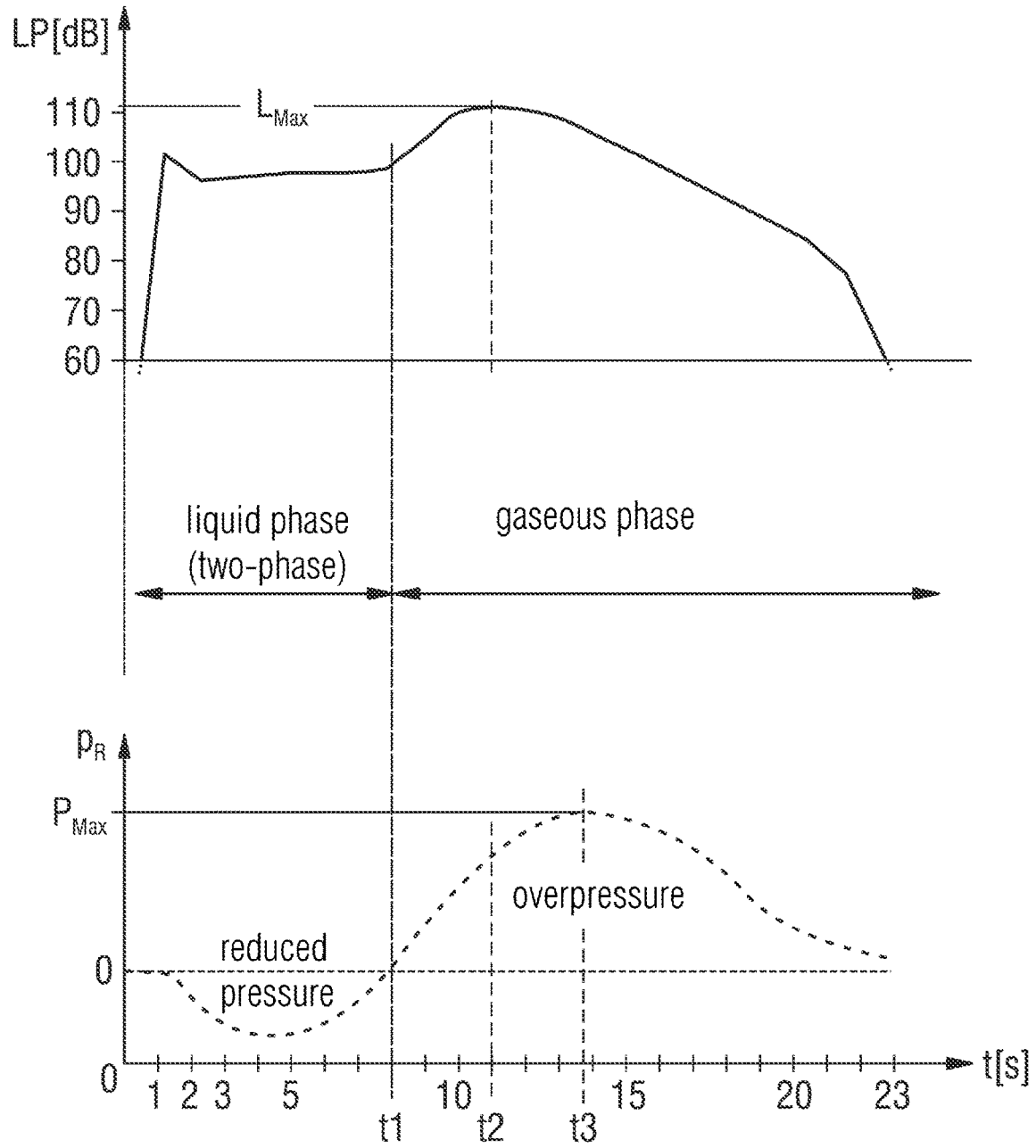
FIG 1 PRIOR ART
FIG. 1 shows an example of the timing curve of the noise occurring during the discharge of a gas extinguisher system and of the room air overpressure according to the prior art.

Referring now to the figures of the drawing in detail and first, particularly, to FIG. 1 thereof, there is shown an example of the timing curve of the noise occurring during the discharge of a gas extinguisher system and of the room air overpressure according to the prior art.

In the upper part of FIG. 1 the sound level LP in dB is plotted over the time t as a measure for the noise, in the lower part of FIG. 1 the room air overpressure $p_R$ in bar is plotted along the same time axis.

As shown in FIG. 1, on transition of the extinguishing fluid from the fluid into the gaseous phase, the noise on the one hand and the room air overpressure or the ambient pressure on the other hand increase significantly. The plotted room air overpressure $p_R$ in this case is related as reference level to the normal atmospheric pressure obtaining in the environment of the gas extinguisher system and typically, in the non-actuated case of the gas extinguisher system, has a pressure value of around 0 Pa. The phase transition is represented idealized in the present example as point in time t1. In practice the phase transition occurs within a few seconds. In the present example the maximum sound level value $L_{Max}$ at point in time t2 lies at just over 110 dB. Such sound level values are highly critical for the proper operation of magnetic drives in data centers. At the same time the room air pressure falls, finally recovers and then increases significantly. Related to the plotted room air overpressure $p_R$, this means that this first becomes negative then becomes zero again, i.e. approaches the normal pressure obtaining before actuation again, then rises significantly and reaches its maximum overpressure value $P_{Max}$ at point in time t3. Therefore pressure equalization flaps are provided in order to avoid damage to buildings and materials in the area of the gas extinguisher system caused by room air overpressure values that are too high.

Figure 2:
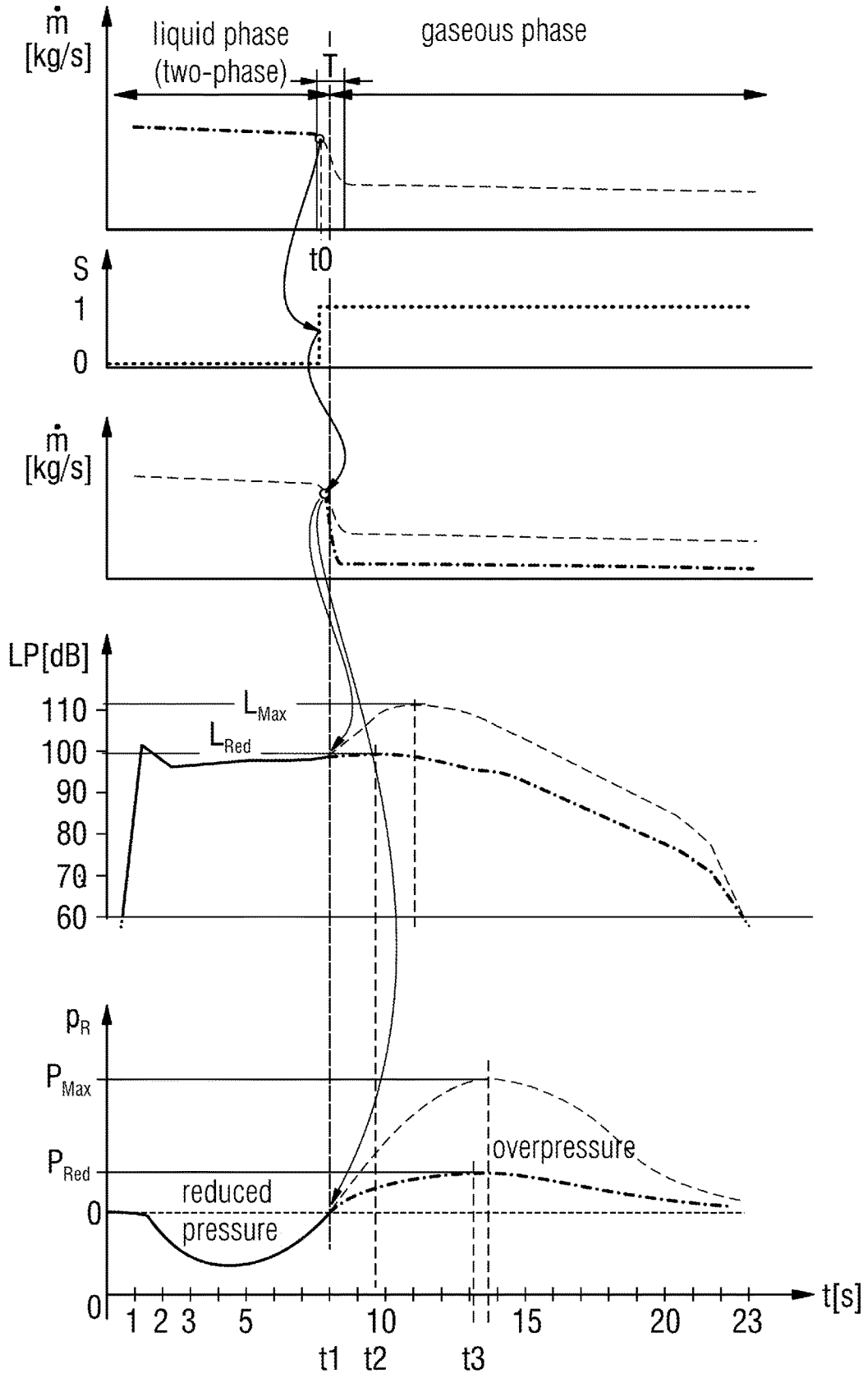
FIG. 2 shows an example of the timing curve of the reduced noise occurring during the discharge of a gas extinguisher system and of the room air overpressure by active reduction of the extinguishing fluid mass flow in accordance with the method according to the invention.

FIG. 2 shows, by way of example, the graph over time of the reduced noise and room air overpressures occurring during the discharge of a gas extinguisher system by active reduction of the extinguishing fluid mass flow m in accordance with the inventive method.

In the lower part of FIG. 2 the sound level LP is again plotted over the time t and below this curve the room air overpressure $p_R$ is plotted. To the right of point in time t1 the curve of the sound level LP and room overpressure $p_R$ for the not actively reduced case of the mass flow m is plotted as a dashed line, against this the corresponding curves for the case with inventive reduction of the mass flow m are plotted as a dotted and dashed line with a thicker line width. Additionally the curve of the mass flow m of the extinguishing fluid is plotted in the upper part of FIG. 2.

In accordance with the invention, now, in a phase transition period T, which is associated with a significant reduction in the extinguishing fluid mass flow m and a significant increase in the room air overpressure, the mass flow m is reduced.

In the upper curve of the mass flow m shown, at point in time t0, the significant reduction of the mass flow m is detected. Shown to the right thereof is the curve of the mass flow m as said curve would proceed without the inventive further reduction of the mass flow m. The detection of the significant reduction of the mass flow m has the effect for example of changing a course of a logical binary switching state S shown below said curve from the value 0 to the value 1. The logical value 1 can correspond to the activation of a choke or throttle for active further reduction of the mass flow m for example. A logical value of 0 consequently corresponds to no active reduction of the mass flow m. The curve of the now reduced mass flow m is plotted below this curve. This reduction ultimately has the effect of restricting any further increase in noise to a reduced sound level value $L_{Red}$ of around 100 dB at point in time t2 and of restricting the room air overpressure $p_R$ to a maximum pressure value $P_{Red}$ at point in time t3.

Figure 3:
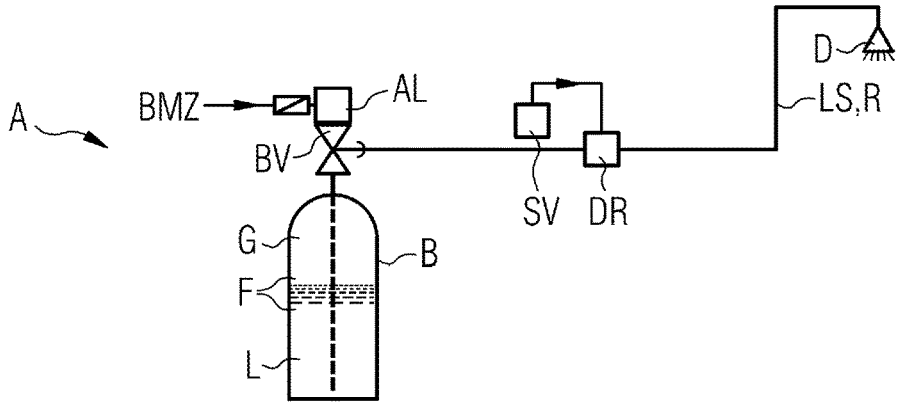
FIG. 3 is a diagram of an exemplary gas extinguisher system according to the invention with a choke disposed in the line system, which is able to be activated via a control facility for reducing or stopping the extinguishing fluid mass flow.

FIG. 3 shows an example for an inventive gas extinguisher system A with a throttle or choke DR, disposed in a line system LS, which is able to be activated via a control facility SV for reducing or stopping the extinguishing fluid mass flow. Only one extinguishing nozzle D is shown at the output-side end of the line system LS for example. The latter is the actual source for the noise and the increase in room or ambient pressure for example.

The gas extinguisher system A only comprises a single pressurized container B for example for pressurizing an extinguishing fluid F. The latter has an extinguishing liquid L, such as Novec® 1230 for example, and a propellant gas G, such as nitrogen for example. The pressurized container B is connected via a container valve BV to the line system LS and to the extinguishing nozzle D. The gas extinguisher system A also has an actuator AL for opening the container valve BV, in order to discharge the extinguishing fluid F into the line system LS. In the present example the actuator AL is actuated by a fire alarm control center BMZ.

In accordance with the invention a choke DR is disposed in the line system LS which is able to be activated via a control facility SV for reducing or stopping the extinguishing fluid mass flow. The control facility SV is configured to activate the choke DR during phase transition of the extinguishing fluid F from a predominantly liquid phase into a predominantly gaseous phase. The phase transition can for example be established by sensors. The phase transition can also be deemed to be established after a predetermined delay time has elapsed after the actuation of the gas extinguisher system A.

Figure 4:
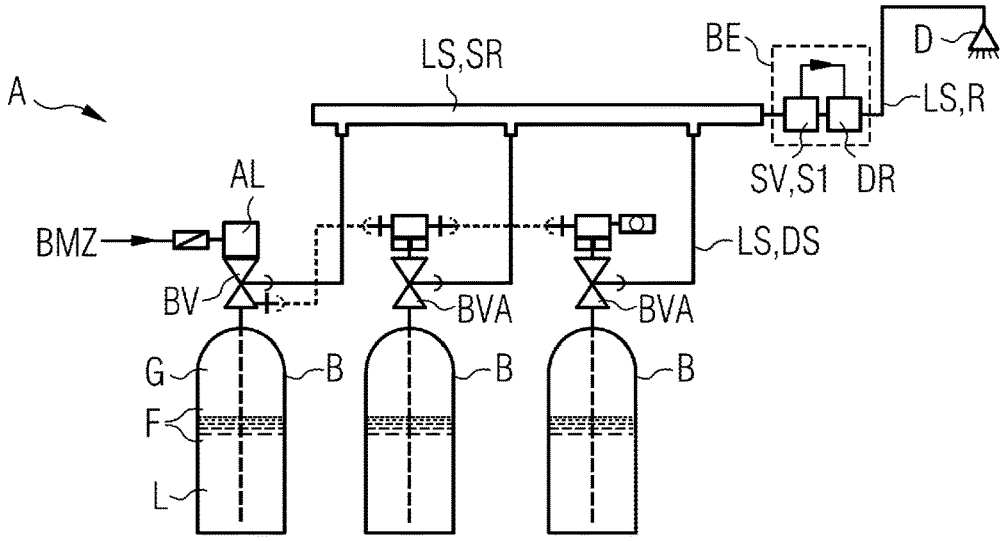
FIG. 4 shows an example of an inventive gas extinguisher system according to a first form of embodiment.

FIG. 4 shows an example for an inventive gas extinguisher system A according to a first form of embodiment. In this example the gas extinguisher system A has a number of pressurized containers B. The left-hand pressurized container B is connected via a container valve BV and by a pressure hose DS to the line system LS. The container valve BV is activated in this case in the event of being actuated by an actuator AL to open the valve. The two other containers are each connected via a container valve actuator BVA and via a pressure hose DS in each case to a common conduit SR. The two right-hand container valve actuators BVA are actuated together by the upstream container valve BV of the left-hand pressurized container B. Both the pressure hoses DS, collective pipe SR and also the pipe R for connecting the collective pipe SR with the extinguishing nozzle D are components of the line system LS.

As FIG. 4 also shows, the control facility SV, which has only one pressure sensor S1 for detecting the line pressure, and the choke DR are combined into one constructional unit BE. The control facility SV in this case can have (exclusively) mechanically, hydrodynamically and/or hydrostatically-acting components for actuating the choke DR, such as a pressure switch S1 for example as pressure sensor, which mechanically changes its switching state when the pressure drops below a predetermined pressure value.

The control facility SV and the choke DR can for example have a common flow flap or a common flow valve as a constructional unit BE which, on phase transition of the extinguishing fluid F preferably flaps or springs or snaps irreversibly, and consequently reduces the flow cross-section for the extinguishing fluid F. This constructional unit BE can also be embodied so that the flow flap or the flow valve can be reset again after the discharge of the gas extinguisher system A.

Figure 5:
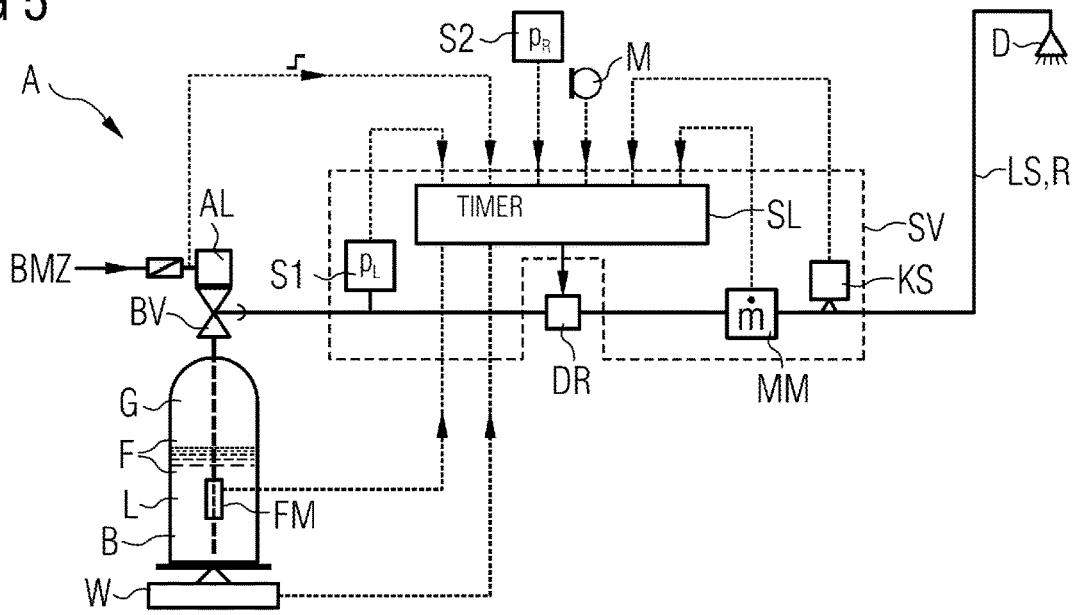
FIG. 5 shows an example of an inventive gas extinguisher system according to a second form of embodiment.

FIG. 5 shows an example for an inventive gas extinguisher system A in accordance with a further form of embodiment. In this example different embodiments of the control facility SV are shown together in one figure.

In the present case the control facility SV has a switching logic SL, which can be realized for example by a processor-assisted control computer. As an alternative the switching logic SL can have one or more switching relays or threshold switches with a preferably floating switching contact. On the output side the switching logic SL activates the choke DR for reducing the mass flow m. In the example shown the latter is an electrically-activatable choke.

The control facility SV can only have one of the detectors or sensors S1, S2, M, KS, MM shown for detection of the phase transition from the predominantly liquid phase of the extinguishing fluid F into the predominantly gaseous phase.

As an alternative or in addition it can have a switching input for triggering a time delay element TIMER with a predetermined delay time by the actuator AL or by the upstream fire alarm control center BMZ. In the case of at least two input signals these can be logically combined by the OR switching logic, so that in respect of time the first input signal arriving on detection of the phase transition or the time-delayed signal from the time delay element TIMER is definitive for the activation of the choke DR.

In the present example the control facility SV has, as one of a number of sensors, a first pressure sensor S1 for detecting the line pressure $p_L$ in the line system LS of the gas extinguisher system A. As an alternative the control facility SV can be connected to this pressure sensor S1 for exchange of signals or data. If a detected line pressure value is below a predeterminable comparison value, the choke DR is activated.

Furthermore the control facility SV can have a second pressure sensor S2 for detecting the room air overpressure $p_R$ in the area of the gas extinguisher system A or be connected to the latter for exchange of signals or data. If a detected room air overpressure value exceeds a predeterminable comparison value, the choke DR is activated.

The control facility SV can furthermore, as an alternative or in addition, have a microphone M for picking up the noise in the area of the gas extinguisher system A or be connected to the latter for exchange of signals or data. If a noise level value exceeds a predeterminable comparison value the choke DR is activated.

Furthermore the control facility can be connected to a sound-borne sensor KS attached to a component of the gas extinguisher system A for detecting the structure-borne sound or can be connected to the latter for exchange of signals or data, such as e.g. to a pipe of the line system LS. If a detected sound-born noise level value exceeds a predeterminable comparison value, the choke DR is activated.

Furthermore the control facility SV can have a mass flow meter MM for detecting the extinguishing fluid mass flow m flowing in the line system LS. If a detected value for the extinguishing fluid-mass flow m falls below a predeterminable comparison value, the choke DR is activated.

As an alternative or in addition the control facility SV can be connected for exchange of signals or data to a fill level meter FM of a pressurized container B. If a detected fill level value falls below a predeterminable comparison value, the choke DR is activated.

Finally the control facility SV can also have a weighing facility W, such as scales or a force measuring cell, for example or be connected to the latter for exchange of signals or data. If a detected weight value falls below a predeterminable comparison value, the choke DR is also activated here.

The following is a summary list of reference numerals and the corresponding structure used in the above description of the invention:

A Gas extinguisher system
AL Actuator
B Pressurized container
BE Constructional unit
BMZ Fire alarm control center
BV Container valve
BVA Container valve actuator
D Extinguishing nozzle
DR Choke, throttle valve, reduction valve, restriction valve
DS Pressure hose
F Extinguishing fluid
FM Fill level meter, float
G Propellant gas
KS Sound-borne sensor
L Extinguishing liquid
$L_{Max}$ Maximum sound level value
LP Sound level $L_{Red}$ Produced sound level value
LS Line system
m Mass flow
M Microphone
MM Mass flow meter
$p_L$ Line pressure
$P_{Max}$ Maximum overpressure value
$p_R$ Room air overpressure
$P_{Red}$ Overpressure value
R Pipe, pipe system
S Switching state
S1, S2 Pressure sensor
SL Switching logic, control computer
SR Conduit pipe
SV Control facility
T Phase transition period
t, t0-t3 Time, points in time
TIMER Time delay element, timer, timing element
W Weighing facility, scales

The invention claimed is:

1. A method of reducing noise and room air overpressure on discharge of a gas extinguisher system, the method comprising:

during the discharge, conveying an extinguishing fluid from a pressurized container via a container valve and line system to an extinguishing nozzle, the extinguishing fluid stored in the pressurized container having an extinguishing liquid and a propellant gas, wherein the extinguishing fluid is present in the line system at the beginning of the discharge predominantly in a liquid phase and, upon discharge, the extinguishing liquid changes into a predominantly gaseous phase; and detecting a phase transition period that is associated with a significant reduction in an extinguishing fluid mass flow and a significant increase in the noise and a room air pressure, and in response to detecting the phase transition period, activating a choke or a throttle to reduce or stop the mass flow.

2. The method according to claim 1, which comprises reducing the mass flow to thereby restrict a sound level of the noise arising during the discharge to a maximum value of 100 dB.

3. The method according to claim 1, which comprises reducing the mass flow to thereby restrict the room air pressure to an overpressure value ranging from 200 to 1000 Pa.

4. The method according to claim 1, wherein the phase transition period is detected dependent on a parameter selected from the group consisting of time, line pressure, ambient pressure, noise, a fill level of the pressurized container, a weight of the pressurized container, and a value for the mass flow acquired by measurement.

5. The method according to claim 1, which comprises reducing the mass flow in a single stage.

6. The method according to claim 1, wherein the phase transition period is detected dependent on a signal from a sensor.

7. The method according to claim 6, wherein the sensor is selected from the group consisting of a pressure sensor, a microphone, a sound-born sensor, and a mass flow meter.

* * * * *